US012359565B2

(12) United States Patent
Chowdhury et al.

(10) Patent No.: US 12,359,565 B2
(45) Date of Patent: Jul. 15, 2025

(54) REAL TIME DOWNHOLE WATER CHEMISTRY AND USES

(71) Applicant: CONOCOPHILLIPS COMPANY, Houston, TX (US)

(72) Inventors: Subhadeep Chowdhury, Houston, TX (US); Gary W. Targac, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 18/426,667

(22) Filed: Jan. 30, 2024

(65) Prior Publication Data

US 2024/0218792 A1 Jul. 4, 2024

Related U.S. Application Data

(63) Continuation of application No. 17/891,678, filed on Aug. 19, 2022, now Pat. No. 11,920,468.

(60) Provisional application No. 63/271,803, filed on Oct. 26, 2021.

(51) Int. Cl.
*E21B 49/08* (2006.01)
*E21B 47/07* (2012.01)

(52) U.S. Cl.
CPC ..... *E21B 49/082* (2013.01); *E21B 47/07* (2020.05)

(58) Field of Classification Search
CPC ..... E21B 49/082; E21B 49/08; E21B 49/081; E21B 49/083; E21B 49/087; E21B 49/0875; E21B 47/06; E21B 47/07; E21B 47/00; E21B 47/10; E21B 47/11; E21B 47/113
See application file for complete search history.

(56) References Cited

U.S. PATENT DOCUMENTS

| | | | |
|---|---|---|---|
| 7,373,813 | B2 | 5/2008 | DiFoggio |
| 7,784,339 | B2 | 8/2010 | Cook et al. |
| 8,104,338 | B2 | 1/2012 | DiFoggio |
| 8,656,996 | B2 | 2/2014 | Willingham et al. |
| 8,960,294 | B2 | 2/2015 | Freese et al. |
| 9,239,406 | B2 | 1/2016 | Kalia et al. |

(Continued)

FOREIGN PATENT DOCUMENTS

GB 2587587 A 11/2021

OTHER PUBLICATIONS

Skuce, M. E. "Isotopic Fingerprinting of Shallow and Deep Groundwaters in Southwestern Ontario and its Applications to Abandoned Well Remediation" (2014) A thesis submitted in partial fulfillment of the requirements for he MS degree in Geology, Western University, Ontario.

(Continued)

*Primary Examiner* — Yanick A Akaragwe
(74) *Attorney, Agent, or Firm* — Boulware & Valoir PLLC

(57) ABSTRACT

Method of monitoring produced water at each perforation or entry point by real time ion sensor deployed downhole to measure the content of water soluble ions is discussed. Methods of determining and differentiating nature of water breakthrough in oil production; such as between cycled injection water through a void space conduit, matrix swept injection water and formation water, especially as relates to offshore oil production, are also discussed. Real time ion sensors are deployed and compared with known standards to monitor and remediate water breakthrough, prevent scale deposition, and the like.

13 Claims, 5 Drawing Sheets

(56) References Cited

U.S. PATENT DOCUMENTS

| | | | | |
|---|---|---|---|---|
| 9,435,192 | B2 | 9/2016 | Lawrence et al. | |
| 9,863,243 | B1 | 1/2018 | Hess | |
| 10,060,250 | B2 | 8/2018 | Samson et al. | |
| 10,815,777 | B2 | 10/2020 | Collins | |
| 2003/0167834 | A1* | 9/2003 | Weintraub | E21B 49/10 73/152.05 |
| 2017/0363077 | A1* | 12/2017 | Gisolf | F04B 47/02 |
| 2018/0148633 | A1 | 5/2018 | Ayirala et al. | |
| 2020/0033316 | A1* | 1/2020 | Long | G01N 33/241 |
| 2020/0400858 | A1* | 12/2020 | Olapade | E21B 49/005 |

OTHER PUBLICATIONS

Phillips, D. L.; Gregg, J. W. "Source partitioning using stable isotopes: coping with too many sources" (2003) Oecologia, 136, 261-269.

Moore, J. W.; Semmens, B. X. "Incorporating uncertainty and prior information into stable isotope mixing models" Ecology Letters (2008) 11, 470-480.

Parnell, A. C.; Inger, R.; Bearhop, S.; Jackson, A. L. "Source partitioning using stable isotopes: coping with too much variation" PLoS One 5, 1-5.

Supplementary Partial European Search Report for Application EP22887878 dated Sep. 24, 2024.

* cited by examiner

FIGURE 1.

Table 4-1. Concentration of the Major Ions (From Pilson, 1998, Chapter 4)

*Constituents of the major constituents in surface seawater*

| | | *At salinity (PSS 1978): S= 35.000%* | | |
|---|---|---|---|---|
| | *mg kg$^{-1}$ S$^{-1}$* | *g/kg* | *mmol/kg* | *mM* |
| $Na^+$ | 308.0 | 10.781 | 468.96 | 480.57 |
| $K^+$ | 11.40 | 0.399 | 10.21 | 10.46 |
| $Mg^{2+}$ | 36.69 | 1.284 | 52.83 | 54.14 |
| *$Ca^{2+}$ | 11.77 | 0.4119 | 10.28 | 10.53 |
| *$Sr^{2+}$ | 0.227 | 0.00794 | 0.0906 | 0.0928 |
| $Cl^-$ | 552.94 | 19.353 | 545.88 | 559.40 |
| $SO_4^{2-}$ | 77.49 | 2.712 | 28.23 | 28.93 |
| *$HCO_3^-$ | 3.60 | 0.126 | 2.06 | 2.11 |
| $Br^-$ | 1.923 | 0.0673 | 0.844 | 0.865 |
| $B(OH)_3$ | 0.735 | 0.0257 | 0.416 | 0.426 |
| $F^-$ | 0.037 | 0.00130 | 0.068 | 0.070 |
| Totals | 1004.81 | 35.169 | 1119.87 | 1147.59 |
| *Alkalinity | - | - | 2.32 | 2.38 |
| Everything else | - | ~0.03 | - | - |
| Water | - | ~964.80 | ~53,555.00 | ~54,881.0 |

REAL TIME DOWNHOLE WATER CHEMISTRY AND USES

PRIOR RELATED APPLICATIONS

This application is a continuation of U.S. application Ser. No. 17/891,678 (pending), filed on Aug. 19, 2022, which claims priority to U.S. Application No. 63/271,803, filed Oct. 26, 2021, each incorporated by reference in its entirety for all purposes.

FEDERALLY SPONSORED RESEARCH STATEMENT

Not applicable.

FIELD OF THE DISCLOSURE

The disclosure generally relates to methods of determining water breakthrough in oil production, especially as related to offshore oil production. Real time ion sensors are deployed and when compared with known standards can be used to monitor and remediate water breakthrough.

BACKGROUND OF THE DISCLOSURE

"Produced water" is water that is brought to the surface during oil and gas exploration and production. In traditional oil and gas wells, produced water is brought to the surface along with oil or gas, where it is then separated from the hydrocarbons, treated and recycled or disposed of.

The physical and chemical properties of produced water varies considerably depending on the geographic location of the field, the geological formation from which it comes, and the type of hydrocarbon product being produced. Produced water properties and volume can even vary throughout the lifetime of a reservoir as formation waters become depleted and/or various injection waters contribute to fluids in the reservoir. In addition, when drilling offshore, leakage from seawater can contribute to produced water.

The major constituents of interest in produced water are:

Salt content: Salt content can be expressed as salinity, total dissolved solids, or electrical conductivity. The salt content in produced water varies widely, from nearly freshwater to salt levels up to ten times higher than seawater.

Oil and grease: Oil and grease is not an individual chemical. Rather, the term "oil and grease" refers to a common test method that measures many types of organic chemicals that collectively lend an "oily" property to the water.

Various inorganic and organic chemicals: Some of these chemicals are found naturally in the formation, are transferred to the water through long-term contact with the hydrocarbon, or may be chemical additives used during drilling and operation of the well. The presence of specific chemicals and the concentrations of those chemicals vary widely among different produced water samples.

Naturally occurring radioactive material (NORM): Some of the formations holding oil and gas have small concentrations of natural radioactivity. Low levels of the radioactivity can be transferred into produced water. Generally, the radiation levels in produced water are very low and pose no risk. However, scale from pipes and sludge from tanks holding produced water can concentrate NORM.

The cost of managing produced water is a significant factor in the profitability of oil and gas production. The total cost (ranging from less than 1 cent/bbl to more than $5/bbl) includes:

The cost of constructing treatment and disposal facilities, including equipment acquisitions;

The cost of operating those facilities, including chemical additives and utilities;

The cost of managing any residuals or byproducts resulting from the treatment of produced water;

Permitting, monitoring, and reporting costs; and

Transportation costs.

Once the cost of managing produced water exceeds the value of the hydrocarbon produced from the well, the well is usually shut down. Since produced water is by far the largest byproduct of oil and gas production, there is always a need to reduce produced water levels per barrel of oil and consequently an imperative to monitor its production.

Thus, what is needed in the art are methods of monitoring the production of formation waters, injected waters and, in offshore environments, seawater. The ideal method would allow the operator to gain real time or near real time information about the production rate of produced waters, the source of those produced waters, e.g., formation water, flowback waters, steam injection waters, seawater, and the like, and provide rates and locations of the various flows. Equipped with such information, the operator gains the ability to shut down zones where water has already achieved breakthrough, address leakage issues, and the like, thus optimizing the production of hydrocarbons and minimizing the production of produced water.

SUMMARY OF THE DISCLOSURE

The chemical constituents of naturally occurring formation waters are quite variable by location, depending on the type of rock, its age, method of formation and other factors. However, naturally occurring formation water—also called field water—will typically contain $K^+$, $Na^+$, $Ca^{2+}$, $Mg^{2+}$, $Cl^-$, $SO_4^{2-}$, and $CO_3^{2-}$ and $HCO_3^-$. In addition, isotope levels will vary with age, as will naturally occurring radioactive material, particularly radium compounds, as well as elements, and both organic and inorganic compounds. The general properties of surface seawater are found in FIG. 1, but as noted, even seawater composition varies with depth, temperature, and natural currents.

Although the contributors to produced water are quite variable, one can ascertain the chemical and isotopic composition of the various waters that may contribute to a produced water in advance and store that data for use during production. For example, waters may be sampled during drilling for analysis, and seawater or injected waters sampled in advance, and the chemical compositions and isotope levels determined and identifying markers or ratios determined. If needed, any contribution from rock or oil may be ascertained and subtracted therefrom.

During production, downhole sensors may be deployed at perforation clusters or other openings to identify the composition of produced waters entering the well at each cluster. Here the detection of water soluble ions in production fluids can be a proxy for the amount of water being coproduced with the oil.

The data may be collected while pulling the sensors uphole, and if needed the sensor may halt at each inflow opening to accumulate additional data. Alternatively, a series of sensors can be sent downhole to each location for data gathering. Data can be collected at a perforation, as well as upstream and downstream therefrom, and data points may also include flow rates and temperature differences, each of which can be used to determine the position of a perforation or other opening.

All of this data is recorded and sent to the surface, where it is then compared against the stored data to determine where a produced water is largely naturally occurring, is flow back, or is leaking seawater, and appropriate remedial steps taken as needed to optimize hydrocarbon production while minimizing produced water production. Alternatively, or in addition, the data is correlated to a total amount of water being produced, regardless of source, and remedial steps taken. This approach may be useful where there are no water injections or steam sweeps, and produced water largely has a natural source, or where any added water exists in known amounts.

Remedial steps may include closing off a well zone that has water breakthrough, addressing any leakage issues; scale removal, fracturing or acid fracturing for flow issues; gels, packing, filling up any channels behind a pipe and/or void space conduit directly connecting injector and producer for water breakthrough, and the like.

As used herein, "perforation" includes any type of opening in the well that allows inflow of fluids, and thus includes perforation clusters, sliding sleeves, inflow control devices and the like.

As used herein, "produced water" means any water produced together with a hydrocarbon from a hydrocarbon well, regardless of the original source of that water.

"Naturally occurring produced water" or "field water" originates from the water naturally present in the formation being produced.

"Produced seawater" originates from the sea or ocean.

"Produced flowback water" is any fluid that has been injected into the formation and is now being returned with the hydrocarbon, e.g., after hydraulic fracturing, reservoir sweeps, steam injections, or various treatments.

Typically, each of these water sources are chemically distinct such that they can be distinguished from each other and often from entry point to entry point. For example, the calcium/chloride ratio is higher in deep seawater than in surface seawaters, as is alkalinity. $Sr^{2+}$ also increases from the surface to the deep water. The nutrient element $PO_4^{3-}$ has a similar pattern and there is an excellent correlation of $Sr^{2+}$ with $PO_4^{3-}$ in both surface waters and with depth. By contrast, $Na^+$, $K^+$, $SO_4^{2-}$, $Br^-$, B and F have constant ratios to $Cl^-$ and each other everywhere in the ocean. These elements are known as "conservative." Until recently, $Mg^{2+}$ levels were thought to be conservative, but we now know that depletions in $Mg^{2+}$ levels mirror increase in $Ca^{2+}$ levels. Thus, $Ca^{2+}$, $Mg^{2+}$, $Sr^{2+}$, and $PO_4^{3-}$ levels and/or ratios with $Cl^-$ can be used to distinguish deep versus surface seawater contamination of produced waters.

Formation waters are much more variable, but typically can be identified by $Na^+/Cl^-$ or $Ca^{2+}/Cl^-$ ratios, and they may also contain distinctive elements, isotopes, or organic and inorganic markers or compounds. Injected waters may include tracers, metals, or additive chemicals unique to the treatment, and these are easily identified. In addition, any of the chemical or ratios discussed herein can be used to identify flowback in the produced waters.

Any suitable downhole sensor can be used herein. For example, U.S. Pat. No. 7,373,813 describes ion selective field effect transistors that can allegedly detect $Na^+$ and $K^+$ ions. U.S. Pat. No. 9,435,192 describes a membrane and electrochemical cell-based sensor that can allegedly detect $H_2S$, $CH_4$, $CO_2$, Hg, $O_2$, and $H_2$, as well as pH and temperature, and benchtop detection of $H_2S$ and $CO_2$ are exemplified. U.S. Ser. No. 10/060,250 describes an optical sensor coupled to a computer via a fiber optic cable that can potentially detect $Na^+$, $K^+$, B, $Ca^{2+}$, $Mg^{2+}$, $Fe^{2+/3+}$, $Ba^{2+}$, $Sr^{2+}$, $Cl^-$, $SO_4^{2-}$, and/or C, although no evidence of downhole functionality is provided. Sensors based on other modalities may also be of use, for example like element spectroscopy, optical analyzers, electrochemical methods, and the like.

U.S. Pat. No. 9,863,243 describes an ion selective electrode (ISE) that is ruggedized by using a solid state electrode, instead of a liquid electrode. The inventors built an iodide ISE and tested it at high temperatures and pressures, and a cesium electrode was tested at ambient conditions.

As used herein, an "ion-sensitive field-effect transistor" or "ISFET" is a field-effect transistor used for measuring ion concentrations in solution; when the ion concentration (such as $H^+$, see pH scale) changes, the current through the transistor will change accordingly. To date, ISFET sensors have been developed to detect pH, $Na^+$, $K+Ca^{2+}$, $NH_4^+$, $Pb^{2+}$, $Cl^-$, $NO_3^-$ and $PO_4^{3-}$, and pH has been measured in the harsh downhole environment.

As used herein, an "ion-selective electrode" or "ISE", also known as a specific ion electrode (SIE), is a transducer (or sensor) that converts the activity of a specific ion dissolved in a solution into an electrical potential. The voltage is theoretically dependent on the logarithm of the ionic activity, according to the Nernst equation. Ion-selective electrodes are used in analytical chemistry and biochemical/biophysical research, where measurements of ionic concentration in an aqueous solution are required.

By "continuously", we mean to include near continuously as well as de facto continuous measurement.

By real time or near real time, we mean that data can be obtained, received, and interpreted within hours or minutes, thus providing optimal opportunities for remediation. By contrast, most experiments require collection of samples and offsite analysis and take days to obtain.

Ideally, the data is transmitted to surface via telemetry while the tool is still in downhole and recording. In case any anomaly is detected—for example a sudden entry of injection water through a perforation into fluid stream downhole—the engineer at surface can relog the interval to ensure the nature of the anomaly and then proceed with any needed remedial actions.

The use of the word "a" or "an" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim. The phrase "consisting of" is closed, and excludes all additional elements. The phrase "consisting essentially of" excludes additional material elements, but allows the inclusions of non-material elements that do not substantially change the nature of the invention, such as instructions for use, connectors, and the like.

Any claim or claim element introduced with the open transition term "comprising," may also be narrowed to use the phrases "consisting essentially of" or "consisting of," and vice versa. However, the entirety of claim language is not repeated verbatim in the interest of brevity herein.

The following abbreviations are used herein:

| ABBREVIATION | TERM |
|---|---|
| ISE | Ion Selective Electrode |
| ISFET | Ion-Sensitive Field-Effect Transistor |
| SIE | Specific Ion Electrode |
| NORM | Naturally Occurring Radioactive Material |
| ECS | Environmental Capture Sonde |
| PLT | Production Logging Tool |

BRIEF DESCRIPTION OF THE DRAWINGS

FIG. 1. Ions in surface seawater.

DETAILED DESCRIPTION

The present invention is exemplified with respect to downhole detection of $Ca^{2+}$, $Na^{+}$, and $Cl^{-}$. However, this is exemplary only, and the invention can be broadly applied to many different ions and/or analytes for which rugged sensors are available. The following examples are intended to be illustrative only, and not unduly limit the scope of the appended claims.

Tools that may be used in the invention include the environmental capture sonde (ECS) by SCHLUMBERGER®—a short, easy to use tool that measures and processes gamma ray spectra, and for accurately defining clay content, mineralogy, and matrix properties. ECS determines relative elemental yields by measuring the gamma rays produced when neutrons bombard the formation and lose energy as they are scattered, primarily by hydrogen. The primary formation elements measured by the ECS in open and cased holes are the most commonly occurring elements: Si, $Fe^{2+/3+}$, $Ca^{2+}$, S, $Ti^{3+}$, $Gd^{3+}$, $Cl^{-}$, $Ba^{2+}$ and $H^{+}$.

Other measurements that may be taken simultaneously include temperature, pressure, density, capacitance, and spinner (flow rate), and the like.

Unlike surface water chemistry, downhole water chemistry measurement will not have the direct water sample available. In this case, an indirect method-like element spectroscopy, optical analyzer, electrochemical methods could also be used.

Since the samples being analyzed are mixed oil, gas and water samples, the tool selected will need to be able to withstand such conditions, and be able to track water born ions even when crude oil is present. Thus, proof of concept work will likely require comparison against produced fluids that are samples, separated and analyzed in bench top experiments. Even when there are differences between the two types of analysis, collection of sufficient downhole and bench top data will allow us to provide the needed correction factors.

For example, crude oil also contains sulfur, nitrogen, and oxygen in small quantities. Metals present in the crude oil are mostly Ni(II) and V(II) porphyrins and non-porphyrins. Other metal ions reported form crude oils, include copper, lead, iron, magnesium, sodium, molybdenum, zinc, cadmium, titanium, manganese, chromium, cobalt, antimony, uranium, aluminum, tin, barium, gallium, silver, and arsenic. Any of these could contribute to data if these elements were detected, but predetermination of their amounts in a play would allow subtraction from the downhole data.

FIG. 1 shows the top 11 ions in seawater, any one of which can be measured herein. Preferably, non-conservative ions such as calcium, strontium and magnesium are measured so that one can tell the approximate depth of the seawater.

Figure 2A:
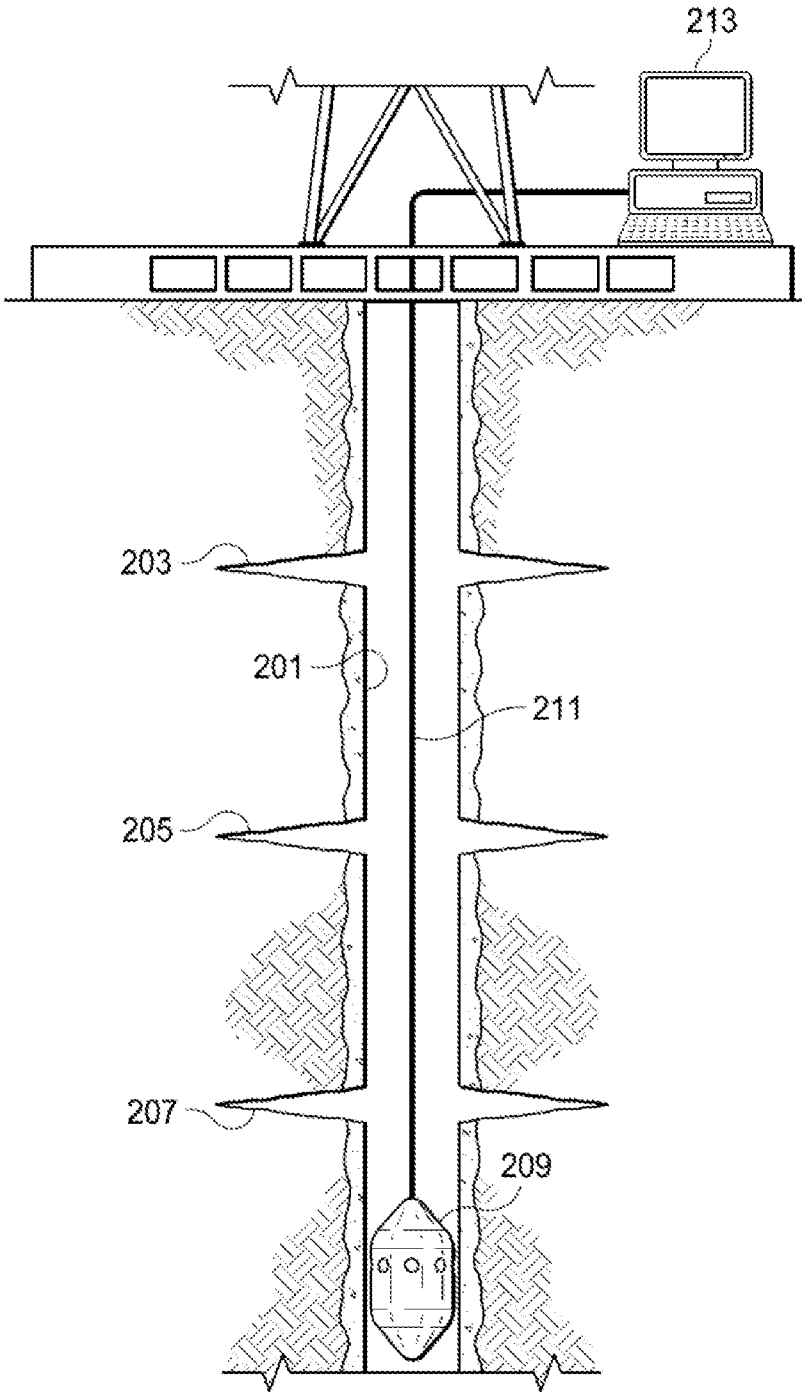
FIGS. 2A, 2B and 2C. Drawing a sensor tool upwell in and taking continuous or near continuous measurements as the tool traverses up the well.
Figure 2B:
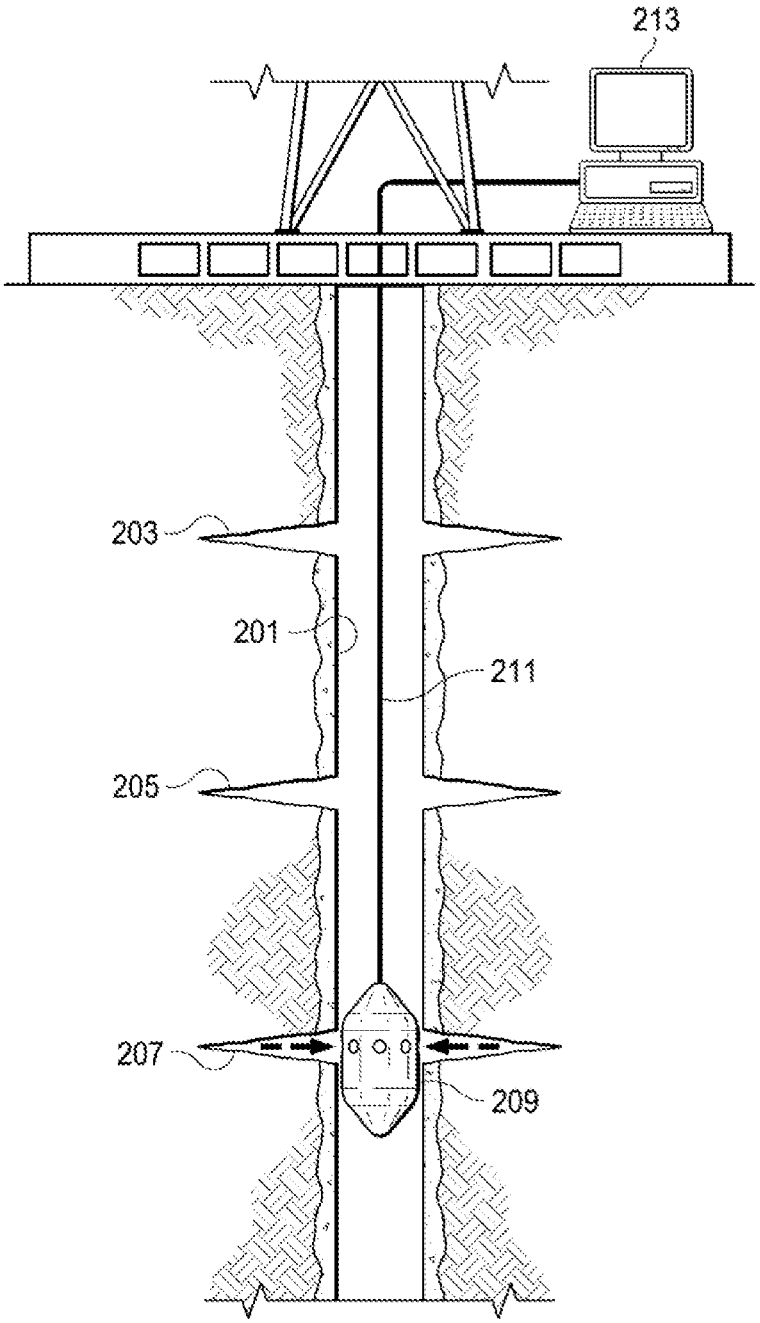
Figure 2C:
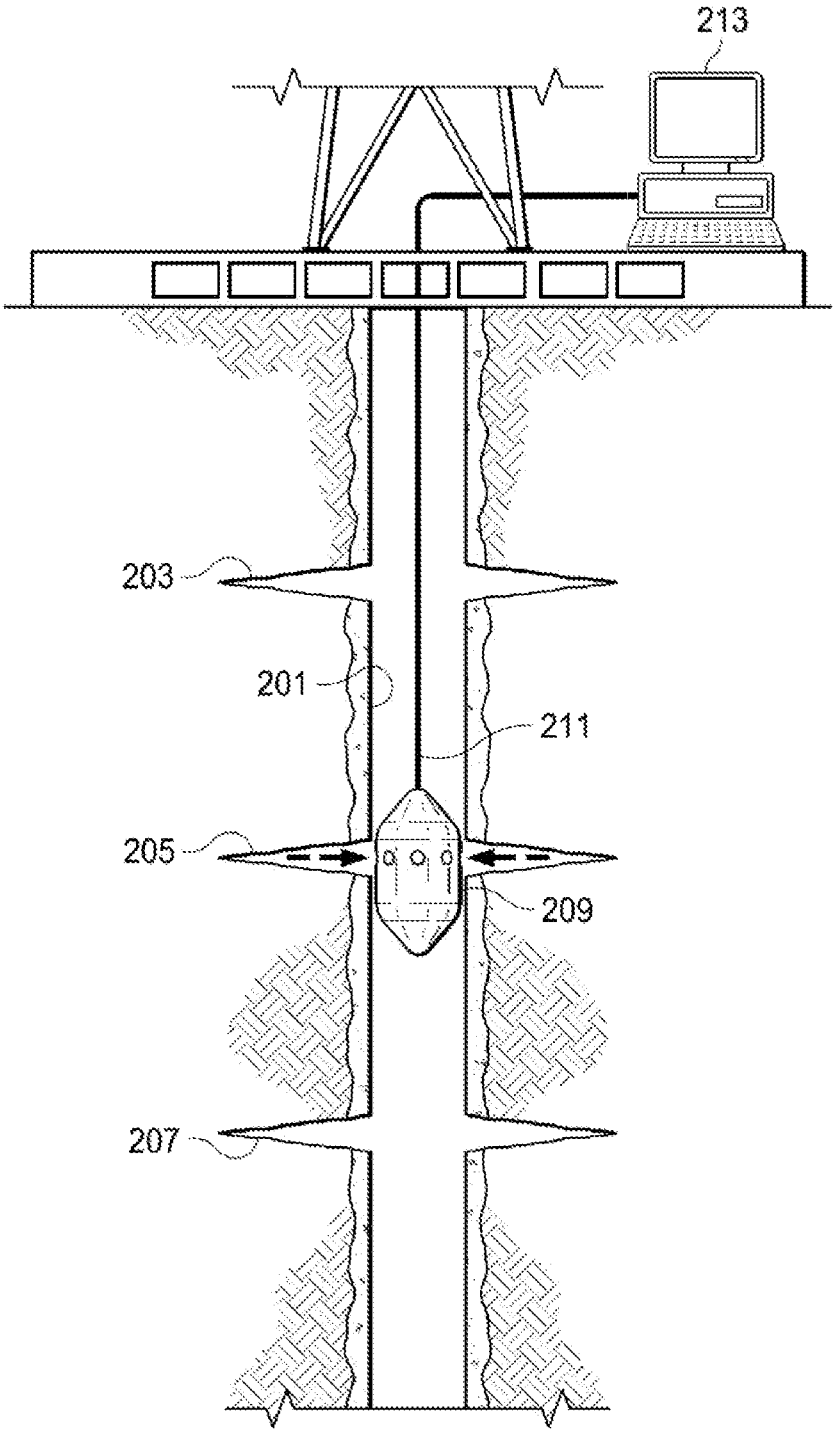

FIG. 2A shows an ion sensor 209 being deployed downhole in production tubing 201, with a number of perforations or perforation clusters 203, 205 and 207. As the tool 209 is drawn uphole in FIGS. 2B and 2C, via e.g., wireline 211, it collects data, which is typically sent to a computer 213 on the surface. Inflow typically increases at each perforation (see arrows in 2B and 2C) and such data is particularly useful.

Figure 3:
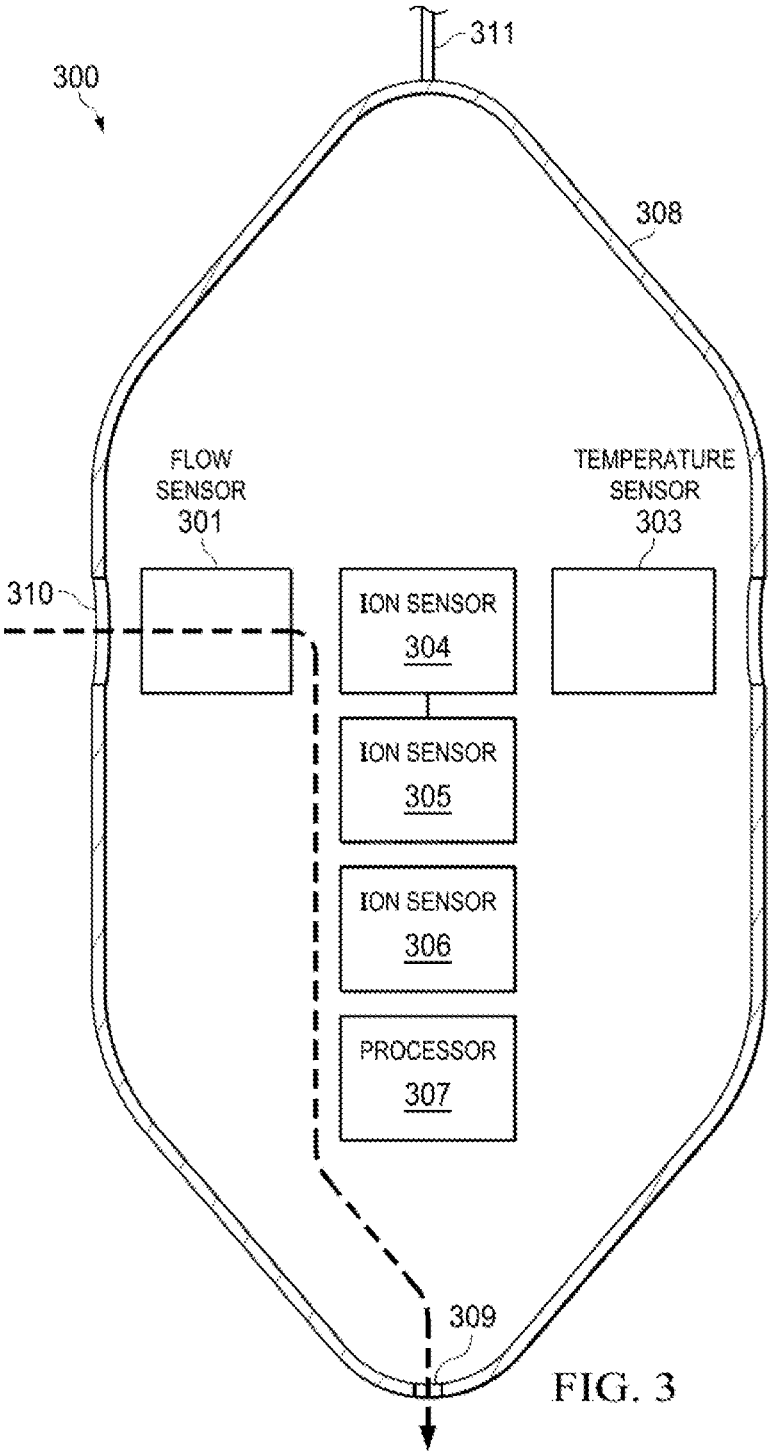
FIG. 3. A simplified schematic of an ion sensor well tool.

The tool itself 300 is shown in simplified schematic in FIG. 3. Tool 300 has an exterior housing 308 with one or more inlets 310 and outlets 309. As fluid enters the tool 300 (see dotted line for fluid flow) it encounters a variety of sensors, including flow sensor 301 and temperature sensor 303, which could also be on the surface of the housing 308, but here shown inside for protection. Also seen are ion sensors 304, 305, and 306, as well as processor 307 for processing and recording data. Data is typically sent to the surface via wireline 311 or it could also be sent wirelessly if such components are included therein. Electrical connections are omitted herein for simplicity.

Using the devices and methods described herein, it becomes possible to quantify either total water or the proportion of produced natural formation water versus flowback versus seawater from each perforation at any given condition-such as steady state and stable flowing, transient condition, cross flow or complete shut-in/no flow, etc. Armed with this information, the operator can take appropriate steps to remediate the excess production of various waters and thus optimize the economics of hydrocarbon production.

This technology should be able to calculate ion concentration of water in a multiphase situation such as water, oil, and gas, and should be applicable in any type of well trajectory such as vertical, slanted, highly deviated, horizontal lateral.

Once the water chemistry is fully analyzed for wells in a field, it will add tremendous value towards tracking the flood front and evaluate the sweep efficiency of the flood. The water chemistry should also indicate section of the wellbore susceptible to scaling, and therefore help in prevention or scale removal well intervention.

The sensors and downhole analyzer instrument can be added to a profile logging tool or as a separate individual drift run. This could be run as usual with wireline/pipe conveyed logging/tractor. However, a preferred option may be to attach it with a production logging tool (PLT).

When in contact with water downhole, the tool would be estimating the ionic concentration of the water in real-time or near real-time and transmit that data to surface with other data like pressure, temperature, capacitance, flow rates, etc. The engineer will then be able to detect the types of water contributed by each perforation/sleeve/zone and adjust as needed.

Any method of calculating the contributions of the various sources to the produced water may be used. For example, isotope-based statistical mixing models are commonly used by ecologists to estimate food source proportions in complex ecosystems, but can be also used for a wide range of applications. Herein, a mixing model known as SIAR could be used to estimate water source proportions (see e.g., Kruse, 2014).

SIAR (Stable Isotope Analysis in R) is an open source software package that runs in the free statistical computing environment "R" (r-project.org/) (Parnell, 2010). The model uses Markov Chain Monte Carlo (MCMC) methods to produce simulations of possible source proportions consistent with the data using a Dirichlet prior distribution. The resulting posterior probability density distributions of the feasible source proportions allow direct identification of the most likely solution, and upper and lower credibility intervals describe the possible range of source proportions. MixSIR is fundamentally very similar (Moore & Semmens, 2008).

IsoSource (Phillips & Gregg, 2003) is another model commonly used to evaluate these such problems, providing a suite of possible or feasible solutions. It does so by iteratively evaluating all possible combinations of each source contribution (0-100%) in small increments (e.g., 1%). Combinations that sum to the observed isotopic composition of the mixture, within a small tolerance (e.g., 0.1%%), are considered as feasible solutions, from which the frequency and range of potential source contributions is determined.

The invention includes any one or more of the following embodiment(s) in any combination(s) thereof, but each possible combination is not separately listed in the interests of brevity:

A method of optimizing hydrocarbon production and minimizing produced water production; said method comprising:

deploying a tool comprising one or more ion sensitive sensor(s) downhole in a hydrocarbon well in a formation;

measuring a concentration of at least two ions in water at an inflow perforation in said well using said one or more ion sensitive sensor(s), said at least two ions selected from calcium, sodium, chloride, magnesium, strontium, sulfur, iron and boron;

comparing said measured concentrations against known concentrations of said at least two ions in i) natural formation water from said formation, ii) water injected into said formation, and iii) seawater above said formation if said well is an offshore well;

determining a contribution of i), ii) and iii) to produced water based on said comparison; and applying mitigation remedies to reduce said contribution from i, ii and/or iii), thereby optimizing hydrocarbon production and minimizing produced water production.

A method of monitoring produced water production; said method comprising:

deploying a tool comprising ion sensitive sensors comprising a calcium sensitive sensor, a sodium sensitive sensor and a chloride sensitive sensor, plus a temperature sensor plus a flow rate sensor downhole in a hydrocarbon well in a formation; and drawing said tool upwell and continuously measuring the following:

a concentration of at least calcium, sodium, and chloride ions;

a temperature;

a rate of flow;

determining inflow positions along said well by a change in temperature and/or rate of flow;

obtaining $Na^+/Cl^-$ and $Ca^{2+}/Cl^-$ ratios at each inflow position;

comparing obtained $Na^+/Cl^-$ and $Ca^{2+}/Cl^-$ ratios and known $Na^+/Cl^-$ and $Ca^{2+}/Cl^-$ from i) natural formation water from said formation, ii) water injected into said formation, and iii) seawater above said formation (if said well is an offshore well);

determining a contribution of i), ii) and iii) to produced water based on said comparison at each inflow position.

Any method herein described, wherein measuring step is repeated at each perforation or at each perforation cluster or other opening in the well that allows inflow of fluids.

Any method herein described, wherein perforations are identified by a change in temperature or a change in flow rate, and said tool comprises a temperature sensor and/or a flow sensor.

Any method herein described, wherein said measuring step is continuous and said measuring occurs before, at, and after each perforation.

Any method herein described, wherein said measuring includes determining calcium, sodium and chloride, and $Na^+/Cl^-$ and $Ca^{2+}/Cl^-$ ratios.

Any method herein described, wherein said tool also includes a pH meter, and pH is measured and used in said comparing step.

Any method herein described, wherein said tool also includes a thermometer, and temperature is measured and used in said comparing step.

Any method herein described, wherein formation water is sampled during drilling to obtain said known concentrations, and/or wherein injection water is sampled before injection to obtain said known concentrations, and/or wherein seawater is sampled at any time to obtain said known concentrations.

Any method herein described, wherein said one or more ion sensor(s) are selected from an ion selective field effect transistor, an ion selective electrode, an ion selective electrode with a solid state electrode, an optical sensor, and an electrochemical sensor.

The following references are each incorporated by reference in their entirety for all purposes:

U.S. Pat. Nos. 7,373,813 and 8,104,338 Method and apparatus for ion-selective discrimination of fluids downhole.

U.S. Pat. No. 9,435,192 Downhole electrochemical sensor and method of using same.

U.S. Pat. No. 9,863,243 Ruggedized downhole tool for real-time measurements and uses thereof.

U.S. Ser. No. 10/060,250 Downhole systems and methods for water source determination.

Kruse, M. E. Isotopic fingerprinting of shallow and deep groundwaters in southwestern Ontario and its applications to abandoned well remediation. Thesis (2014) Univ. Westn. Ont.

Phillips, D. L.; Gregg, J. W. Source partitioning using stable isotopes: coping with too many sources. Oecologia (2003) 136, 261-269.

Moore J. W.; Semmens B. X. Incorporating uncertainty and prior information into stable isotope mixing models. Ecology Letters (2008) 11, 470-480.

Parnell A. C.; Inger, R.; Bearhop, A.; Jackson, A. L. (2010) Source partitioning using stable isotopes: coping with too much variation. PLOS ONE 5, 1-5.

The invention claimed is:

1. A method of monitoring produced water, said method comprising:

a) deploying a tool downhole in a hydrocarbon well in a formation, said tool comprising:

(1) an exterior housing having one or more inlets for an inflow of reservoir fluids and one or more outlets for an outflow of reservoir fluids, (2) a flow sensor inside said housing for measuring a flow rate of said inflow of reservoir fluids, (3) a temperature sensor inside said housing for measuring a temperature of said inflow of reservoir fluids, (4) at least three ion sensor(s) inside said housing for measuring at least three ions in said inflow of reservoir fluids, (5) a processor inside said housing for recording and processing data comprising said flow rate measurements, said temperature measurements and said ion sensor measurements, and (6) means for sending said data to a surface processor;

b) drawing said tool upwell while continuously measuring a temperature and a rate of flow;

c) determining inflow positions along said well by a change in said temperature or a change in said rate of flow or a change in both said temperature and said rate of flow;

d) obtaining concentrations of at least three ions at said inflow positions, said at least three ions selected from calcium, sodium, chloride, potassium, magnesium, iron, sulphate, strontium and bicarbonate;

e) comparing said obtained concentrations of said at least three ions with stored data for a same at least three ions of one or more of i) natural formation water from said formation, ii) water injected into said formation, or iii) seawater above said formation; and f) determining a contribution of one or more of i), ii), and/or iii) to produced water based on said comparison.

2. The method of claim 1, further comprising applying mitigation remedies to reduce said contribution from i), ii) and/or iii), thereby optimizing hydrocarbon production and minimizing produced water production.

3. The method of claim 1, wherein said at least three ions include chloride, sulphate, and strontium.

4. A method of monitoring produced water, said method comprising:

a) deploying a tool downhole in a hydrocarbon well in a formation said tool comprising:

(1) an exterior housing having one or more inlets for an inflow of reservoir fluids and one or more outlets for an outflow of reservoir fluids, (2) a flow sensor inside said housing for measuring a flow rate of said inflow of reservoir fluids, (3) a temperature sensor inside said housing for measuring a temperature of said inflow of reservoir fluids, (4) a pH sensor inside said housing for measuring a pH of said inflow of reservoir fluids, (5) at least three ion sensor(s) inside said housing for measuring at least three ions in said inflow of reservoir fluids, (6) a processor inside said housing for recording and processing data comprising said flow rate measurements, said temperature measurements, said ion sensor measurements, and said pH measurements, and (7) means for sending said data to a surface processor;

b) drawing said tool upwell while continuously measuring a temperature and a rate of flow and a pH;

c) determining inflow positions along said well by a change in said temperature or a change in said rate of flow or a change in both said temperature and said rate of flow;

d) obtaining a pH plus obtaining concentrations of at least three ions at said inflow positions, said at least three ions selected from calcium, sodium, chloride, potassium, magnesium, iron, sulphate, and bicarbonate;

e) comparing said obtained pH and said obtained concentrations of said at least three ions with stored data for a same at least three ions of one or more of i) natural formation water from said formation, ii) water injected into said formation, or iii) seawater above said formation; and f) determining a contribution of one or more of i), ii) or iii) to produced water based on said comparison.

5. The method of claim 4, further comprising applying mitigation remedies to reduce said contribution from i), ii) or iii), thereby optimizing hydrocarbon production and minimizing produced water production.

6. The method of claim 4, wherein said at least three ions include chloride, sulphate, and strontium.

7. A method of monitoring produced water, said method comprising:

a) deploying a tool downhole in a hydrocarbon well in a formation, said tool comprising:

(1) an exterior housing having one or more inlets for an inflow of reservoir fluids and one or more outlets for an outflow of reservoir fluids;

(2) a flow sensor inside said housing for measuring a flow rate of said inflow of reservoir fluids, (3) a temperature sensor inside said housing for measuring a temperature of said inflow of reservoir fluids;

(4) at least three ion sensor(s) selected from an ion selective field effect transistor, an ion selective electrode, an ion selective electrode with a solid state electrode, an optical sensor, and an electrochemical sensor inside said housing for measuring at least three ions in said inflow of reservoir fluids;

(5) a processor inside said housing for processing and recording data comprising said flow rate measurements, said temperature measurements, and said ion sensor measurements; and (6) means for sending said data to a surface processor;

b) drawing said tool upwell while continuously measuring a temperature and a rate of flow;

c) determining inflow positions along said well by a change in said temperature or a change in said rate of flow or a change in both said temperature and said rate of flow;

d) obtaining concentrations of at least three ions at said inflow positions, said at least three ions selected from calcium, sodium, chloride, potassium, magnesium, iron, sulphate, strontium and bicarbonate;

e) comparing said obtained concentrations of said at least three ions with stored data for a same at least three ions of one or more of i) natural formation water from said formation, ii) water injected into said formation, or iii) seawater above said formation; and f) determining a contribution of one or more of i), ii) or iii) to produced water based on said comparison.

8. The method of claim 7, further comprising applying mitigation remedies to reduce said contribution from i), ii) or iii), thereby optimizing hydrocarbon production and minimizing produced water production.

9. The method of claim 7, wherein said at least three ions include chloride, sulphate, and strontium.

10. A method of monitoring produced water, said method comprising: a) deploying a tool downhole in a hydrocarbon well in a formation, said tool comprising:

(1) an exterior housing having one or more inlets for an inflow of reservoir fluids and one or more outlets for an outflow of reservoir fluids, (2) a flow sensor inside said housing for measuring a flow rate of said inflow of reservoir fluids, (3) a temperature sensor inside said housing for measuring a temperature of said inflow of reservoir fluids, (4) a pH sensor inside said housing for measuring a pH of said inflow of reservoir fluids, (5) at least three ion sensor(s) selected from an ion selective field effect transistor, an ion selective electrode, an ion selective electrode with a solid state electrode, an optical sensor, and an electrochemical sensor inside said housing for measuring at least three ions in said inflow of reservoir fluids, (6) a processor inside said housing for recording and processing data comprising said flow rate measurements, said temperature measurements, said ion sensor measurements, and said pH measurements, and (7) means for sending said data to a surface processor;

b) drawing said tool upwell while continuously measuring a temperature and a rate of flow and a pH;

c) determining inflow positions along said well by a change in said temperature or a change in said rate of flow or a change in both said temperature and said rate of flow;

d) obtaining a pH plus obtaining concentrations of at least three ions at said inflow positions, said at least three ions selected from calcium, sodium, chloride, potassium, magnesium, iron, sulphate, strontium and bicarbonate;

e) comparing said obtained pH and said obtained concentrations of said at least three ions with stored data for a same at least three ions of one or more of i) natural formation water from said formation, ii) water injected into said formation, or iii) seawater above said formation; and f) determining a contribution of one or more of i), ii) or iii) to produced water based on said comparison.

11. The method of claim 10, further comprising applying mitigation remedies to reduce said contribution from i), ii) or iii), thereby optimizing hydrocarbon production and minimizing produced water production.

12. The method of claim 10, wherein said at least three ions include chloride, sulphate, and strontium.

13. A method of monitoring produced water, said method comprising:

a) deploying a tool downhole in a hydrocarbon well in a formation, said tool comprising:

(1) an exterior housing having one or more inlets for an inflow of reservoir fluids and one or more outlets for an outflow of reservoir fluids, (2) a flow sensor inside said housing for measuring a flow rate of said inflow of reservoir fluids, (3) a temperature sensor inside said housing for measuring a temperature of said inflow of reservoir fluids, (4) at least three ion sensor(s) inside said housing for measuring at least three ions in said inflow of reservoir fluids, (5) a processor inside said housing for processing and recording data comprising said flow rate measurements, said temperature measurements, and said ion sensor measurements, and (6) means for sending said data to a surface processor;

b) drawing said tool upwell while continuously measuring a temperature and a rate of flow;

c) determining inflow positions along said well by a change in said temperature or a change in said rate of flow or a change in both said temperature and said rate of flow;

d) obtaining concentrations of at least three ions at said inflow positions, said at least three ions comprising chloride, sulphate, and strontium ions;

e) comparing said obtained concentrations of said at least three ions with stored data for a same at least three ions of one or more of i) natural formation water from said formation, ii) water injected into said formation, or iii) seawater above said formation;

f) determining a contribution of one or more of i), ii) or iii) to produced water based on said comparison; and g) applying mitigation remedies to reduce said contribution from i), ii) or iii), thereby optimizing hydrocarbon production and minimizing produced water production.

* * * * *